US007549490B2

(12) United States Patent
McDonough et al.

(10) Patent No.: US 7,549,490 B2
(45) Date of Patent: Jun. 23, 2009

(54) ARRANGEMENT OF ROLLER CONE INSERTS

(75) Inventors: Scott D. McDonough, Houston, TX (US); Amardeep Singh, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 11/557,226

(22) Filed: Nov. 7, 2006

(65) Prior Publication Data

US 2007/0114072 A1 May 24, 2007

Related U.S. Application Data

(60) Provisional application No. 60/739,823, filed on Nov. 23, 2005.

(51) Int. Cl.
*E21B 10/08* (2006.01)

(52) U.S. Cl. ..... 175/398; 175/376; 175/378; 175/431

(58) Field of Classification Search ..... 175/374, 175/376, 378, 398, 428, 431
See application file for complete search history.

(56) References Cited

U.S. PATENT DOCUMENTS

| | | | | |
|---|---|---|---|---|
| 4,334,586 A | | 6/1982 | Schumacher | |
| 4,420,050 A | * | 12/1983 | Jones | 175/374 |
| 4,580,642 A | | 4/1986 | Gosch | |
| 5,199,516 A | * | 4/1993 | Fernandez | 175/366 |
| 6,484,819 B1 | | 11/2002 | Harrison | |
| 2003/0079917 A1 | * | 5/2003 | Klompenburg et al. | 175/431 |

FOREIGN PATENT DOCUMENTS

| | | |
|---|---|---|
| GB | 2 328 966 | 3/1999 |
| GB | 2 344 839 | 6/2000 |
| GB | 2 347 957 | 9/2000 |
| GB | 2 361 497 | 10/2001 |
| WO | 00/12860 | 3/2000 |

OTHER PUBLICATIONS http://dictionary.reference.com/browse/periphery.*
Combined Search and Examination Report issued in corresponding British Application No. GB0623298.7; Dated Feb. 12, 2007; 8 pages.
Official Action from the Canadian Patent Office dated Mar. 10, 2008 (2 pages).
Examination Report issued in corresponding GB Application No. GB0623298.7, dated May 12, 2008, (5 pages).

* cited by examiner

*Primary Examiner*—David J Bagnell
*Assistant Examiner*—Sean D Andrish
(74) *Attorney, Agent, or Firm*—Osha Liang LLP

(57) ABSTRACT

A drill bit having cutting elements disposed on a roller cone surface in a non-linear pattern, wherein at least one of the cutting elements is asymmetrical to its axis of orientation. Also, a method for selecting and adjusting a cutting element orientation based on crater profile geometry which results in increased bottom hole coverage.

14 Claims, 8 Drawing Sheets

ARRANGEMENT OF ROLLER CONE INSERTS

CROSS-REFERENCE TO RELATED APPLICATIONS

This application claims priority, pursuant to 35 U.S.C. §119 of U.S. Provisional Patent Application No. 60/739,823, filed Nov. 23, 2005. That application is incorporated by reference in its entirety.

FIELD OF THE INVENTION

The invention relates generally to earth-boring bits used to drill a borehole for the recovery of oil, gas, or other minerals. More particularly, the invention relates to roller cone rock bits and to an improved cutting structure orientation for such bits. More particularly still, the invention relates to at least one cutter element of symmetrical or asymmetrical design placed along the roller bit circumference in non-concentric configuration and rotated with respect to the at least one cutting element's axis.

BACKGROUND OF THE INVENTION

An earth-boring drill bit is typically mounted on the lower end of a drill string and is rotated by rotating the drill string at the surface or by actuation of downhole motors or turbines, or by both methods. With weight applied to the drill string, the rotating drill bit engages the formation and proceeds to form a borehole along a predetermined path toward a target zone. The borehole formed in the drilling process will have a diameter generally equal to the diameter or "gauge" of the drill bit.

A typical earth-boring bit includes one or more rotatable cutters that perform their cutting function due to the rolling movement of the cutters acting against the formation material. The cutters roll and slide upon the bottom of the borehole as the bit is rotated, the cutters thereby engaging and disengaging the formation material in its path. The rotatable cutters may be described as generally conical in shape and are therefore sometimes referred to as roller cones. Such bits typically include a bit body (12 of FIG. 17) with a plurality of journal segment legs (16 of FIG. 17). The roller cone cutters (28 of FIG. 17) are mounted on bearing pin shafts that extend downwardly and inwardly from the journal segment legs. The borehole is formed as the gouging and scraping or crushing and chipping action of the roller cones remove chips of formation material which are carried upward and out of the borehole by drilling fluid which is pumped downwardly through the drill pipe and out of the bit.

The earth-boring action of the roller cone cutters is enhanced by providing the cutters with a plurality of cutter elements. Cutter elements are generally two types: inserts formed of a very hard material, such as cemented tungsten carbide, that are press fit into undersized apertures or similarly secured in the cone surface; or teeth that are milled, cast or otherwise integrally formed from the material of the roller cone. Bits having tungsten carbide inserts are typically referred to as "TCI" bits, while those having teeth formed from the cone material are known as "steel tooth bits." The cutter elements on the rotating cutters breakup the formation to create the new borehole by a combination of gouging and scraping or chipping and crushing, The cost of drilling a borehole is proportional to the length of time it takes to drill to the desired depth and location. In oil and gas drilling, the time required to drill the well, in turn, is greatly affected by the number of times the drill bit must be changed in order to reach the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which, again must be constructed section by section. As is thus obvious, this process, known as a "trip" of the drill string, requires considerable time, effort and expense. Accordingly, it is always desirable to employ drill bits which will drill faster and longer and which will remove more earth per revolution of the roller cone.

To keep costs down, it is important that the drill bit achieves the highest rate of penetration while drilling a borehole. One cause of slowed drill bit penetration is a cutting structure that allows ridges of uncut earth to build up. The uncut earth is the area on the borehole bottom that is not removed during the formation of the crater. If this uncut area is allowed to build up, it forms a ridge. In some drilling applications this ridge is never realized, because the formation material is easily fractured and the ridge tends to break off. In very soft rock formations that are not easily fractured, however, the formation yields plastically and a ridge may build up. This ridge build-up is detrimental to the cutter elements and slows the drill bit's rate of penetration. For this reason, the cutting structure arrangement must mechanically gouge away a large percentage of the hole bottom in order to drill efficiently.

SUMMARY OF THE INVENTION

According to one aspect of the present invention, a drill bit includes a bit body, at least one roller cone rotatably mounted on a journal extending from the bit body, wherein the roller cone defines a cone axis. Furthermore, the drill bit preferably includes a plurality of cutting elements disposed on the roller cone, each cutting element including a cutting surface and a portion engaged within the roller cone defining an axis of rotation, wherein the plurality of cutting elements is positioned on the drill bit in a non-concentric configuration wherein at least one of the cutting elements has a cutting surface that is asymmetrical to its axis of orientation.

According to another aspect of the present invention, a drill bit includes a bit body, at least one roller cone rotatably mounted on a journal extending from the bit body, the roller cone defining a cone axis. Furthermore, the drill bit includes a plurality of cutting elements disposed on the roller cone, each cutting element including a cutting surface and a portion engaged within the roller cone defining an axis of orientation, wherein at least one of the cutting surfaces of at least one cutting element is asymmetrical with respect to its axis of rotation and wherein at least one cutting element is rotated about the axis of orientation.

According to another aspect of the present invention, a drill bit includes a bit body, at least one roller cone rotatably mounted on a journal extending from the bit body, the roller cone defining a cone axis. Furthermore, the drill bit preferably includes a plurality of cutting elements extending from a row in the roller cone, wherein each cutting element includes an axis of orientation. Furthermore, at least one of the plurality of cutting elements is rotated about the axis of orientation, wherein the plurality of cutting elements is positioned upon the roller cone in a non-concentric configuration.

According to another aspect of the present invention, a method to increase bottom hole coverage comprises selecting a cutting element, making a test crater in a selected formation with the cutting element, calculating a geometric crater profile made by the cutting element to determine the orientation for a cutting element resulting in the greatest bottom hole coverage, arranging a plurality of the cutting elements on a surface of a roller cone, and orienting the plurality of cutting elements according to the calculated geometric crater profile, such that a predicted bottom hole coverage is increased.

Other aspects and advantages of the invention will be apparent from the following description and the appended claims.

DETAILED DESCRIPTION OF THE INVENTION

In general, certain embodiments of the present invention relate to inserts that produce a non-symmetric crater in an earth formation and arranging such inserts on a cone to increase or maximize bottom hole coverage during drilling. In one embodiment, inserts having non-symmetric crests are arranged in non-linear rows to maximize bottom hole coverage. In one embodiment, a non-symmetric crater may be created by having a plurality of chisel shaped inserts on a row of a cone and orienting one or more such that the crest is oriented at 90° with respect to the row such that a "butterfly-shaped" crater results which may have "wings" produced above and below the row being cut rather than oriented to occur along the row being cut to overlap with the crater produced by an adjacent cutting element.

In another embodiment, the row may be sinusoidal (or non-linear form) to reduce overlap of craters formed by adjacent cutting elements, and thus increase bottom hole coverage. In another embodiment, a crest orientation may be combined with adjacent crest offset.

Figure 1:
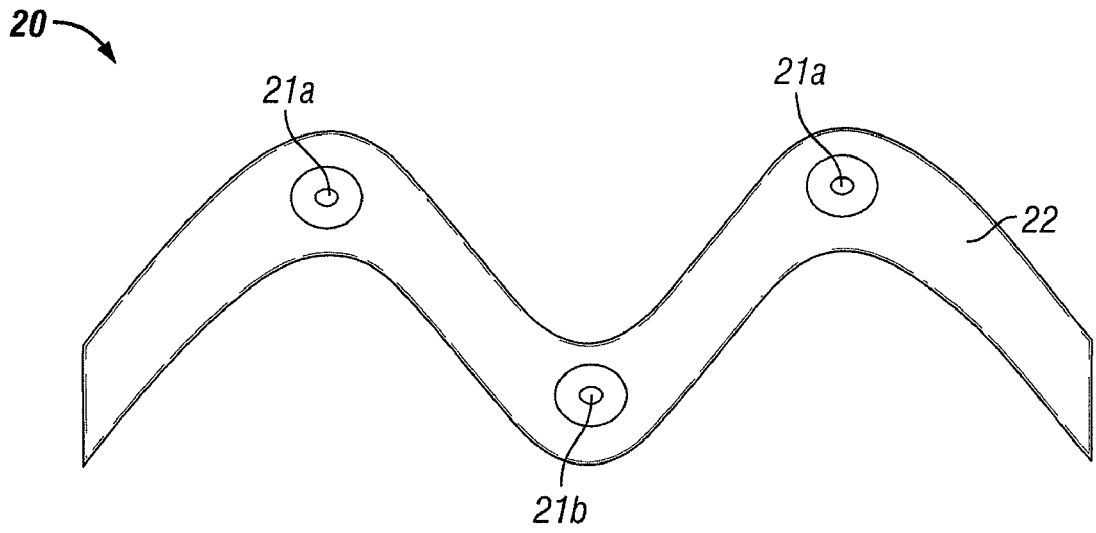
FIG. 1 (PRIOR ART)
FIG. 1 is a schematic view of a portion of the outer surface of a roller cone showing symmetrical inserts in a non-linear configuration.

Referring initially to FIG. 1, a schematic view of a plurality of inserts arranged in a non-liner pattern 20 is shown. In pattern 20, the symmetrical inserts 21*a* and 21*b* are shown spaced evenly along a roller cone surface 22. Roller cone surface 22 normally follows along a circumference of the roller cone, on which symmetrical inserts 21*a* and 21*b* are spaced. Roller cone surface 22 has been depicted in a matter to more clearly show the non-linear spacing of the symmetrical inserts 21*a* and 21*b*.

Figure 2:
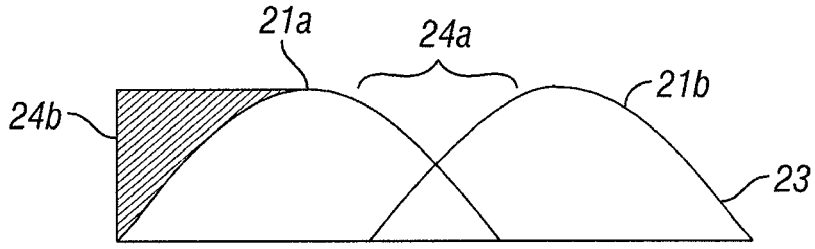
FIG. 2 (PRIOR ART)
FIG. 2 is a profile view along the circumference of the roller cone surface of FIG. 1 showing symmetrical inserts in a non-linear configuration.

Referring now to FIG. 2, an overlapping insert cutting surface 23, as viewed from the roller cone surface 22 of FIG. 1, is shown. Non-linear insert pattern 20 of symmetrical inserts 21*a* and 21*b* results in an expanded bottom hole coverage area by increasing the effective drilling area of a roller cone. While the coverage area of non-linear insert pattern 20 is more effective than linear insert patterns (not illustrated), ridges of earth may still build up as a result of gaps 24*a* in the spacing of symmetrical inserts 21*a* and 21*b*. Undrilled earth may form along the outer edges of inserts 21*a* and 21*b* illustrated as shaded section 24*b*. These ridges build after a number of revolutions, slowing the rate of penetration of the drill bit, therefore resulting in inefficient drilling.

Figure 3:
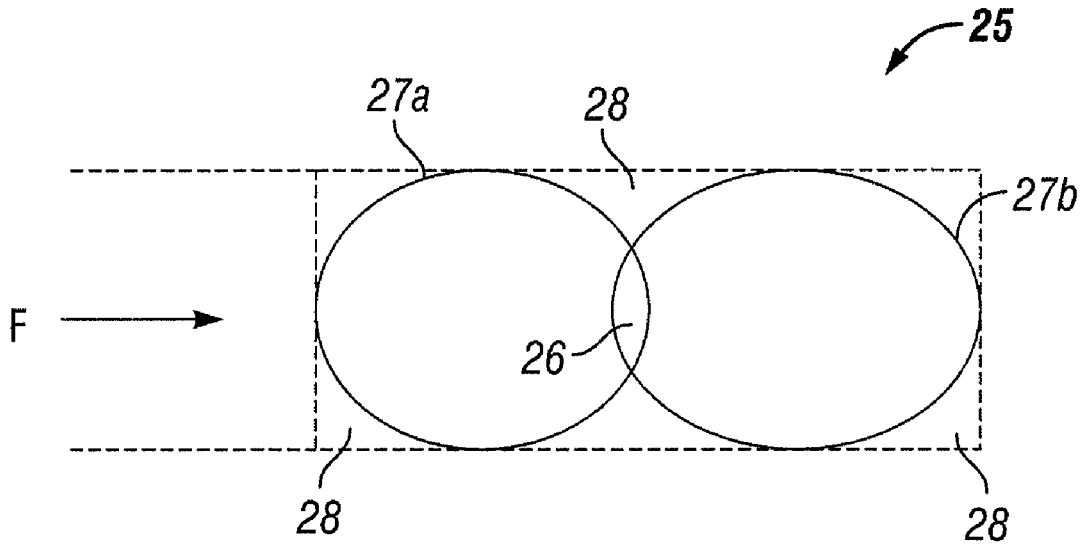
FIG. 3 (PRIOR ART)
FIG. 3 is a top view of the crater shape of a conventional chisel insert.

Referring now to FIG. 3, a crater pattern 25 created by a chisel insert contacting the earth is shown. As an insert strikes the formation in direction F, the impression 26 of the chisel insert crest in the formation as it is moved thereacross creates an overall crater 27*a* and 27*b*. As the insert progresses through and deeper into the formation, crater 27*b* becomes increasingly oblong. Inserts striking the earth in a similar physical location within the formation result in varying crater shapes ranging from generally circular 27*a*, to generally oblong 27*b*. As the varied crater shapes begin to overlap during the drilling process, areas of inconsistent overlap and random areas of direct impression 26 move throughout the crater pattern resulting in additional ridges in the formation. The craters overlap one another in a generally lateral fashion. After a number of revolutions, the ridges created by undrilled formation 28 result in significant build up that may slow the rate of penetration of the drill bit.

Figure 4:
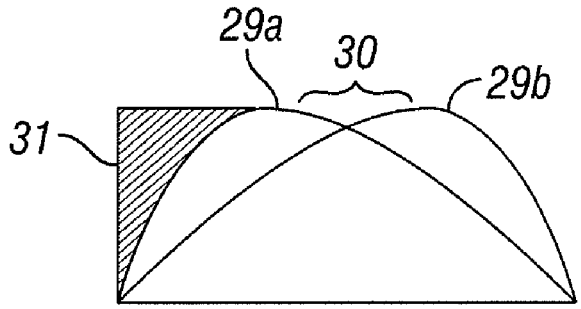
FIG. 4 is a profile view along the circumference of a roller cone surface showing asymmetrical inserts in a linear configuration.

Referring now to FIG. 4, overlapping insert cutting surfaces 29*a*, and 29*b* as viewed from the roller cone surface of an asymmetrical insert pattern oriented linearly, is shown. The area of ridge build up 30 between the cutting surfaces 29*a* and 29*b* of the inserts is less than the area of build up during the operation of a drill bit with symmetrical inserts in non-linear configuration FIG. 2. Furthermore, the coverage of bottom area between the row of inserts illustrated as shaded section 31 is decreased by offsetting cutting surfaces 29*a* and 29*b* toward the outer edges of the roller cone insert row. Contrasted with cutting surface 21*a* of FIG. 2, the cutting surface 29*a* is more steeply angled on its outer edge, thereby reducing the area of uncut formation 31.

Figure 5:
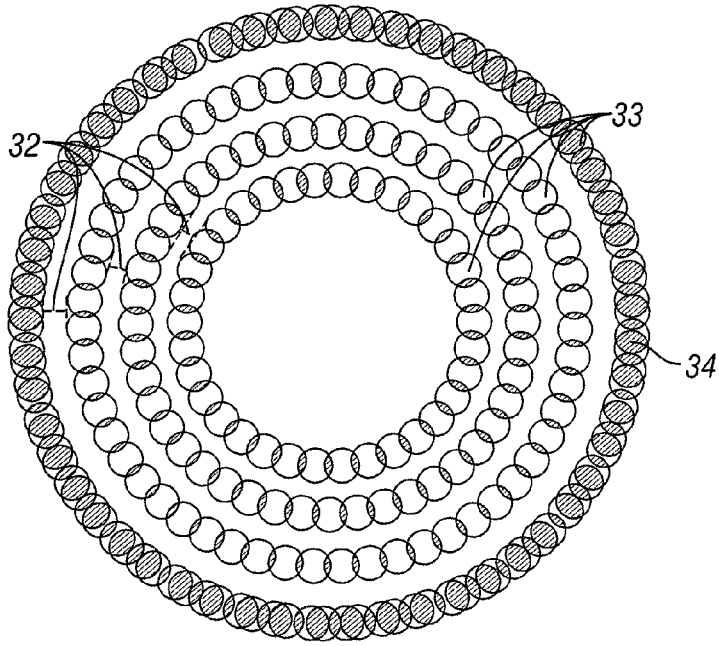
FIG. 5 (PRIOR ART)
FIG. 5 is a top view of the bottom hole coverage of middle rows of cutter inserts oriented as depicted in FIG. 3 after three revolutions.

Referring now to FIG. 5, a standard bottom hole coverage area for a middle row of inserts after three revolutions of a roller cone in linear configuration leaves a substantial area of undrilled earth 32 between each row 33 of inserts. While each row 33 of inserts has multiple areas of overlap 34, the undrilled earth between the rows can result in ridges that may slow the rate of penetration of the drill bit as discussed above.

Figure 6:
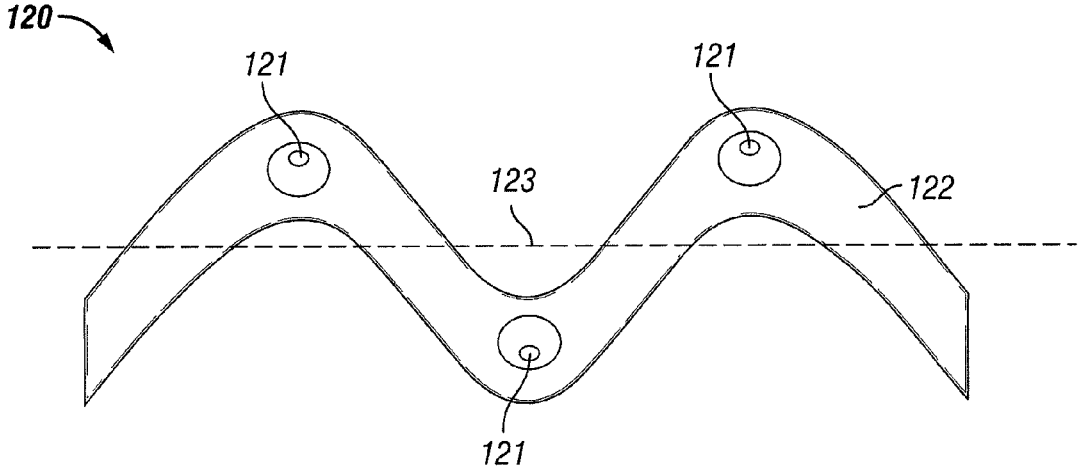
FIG. 6 is a schematic view of a roller cone showing asymmetrical inserts in a non-linear configuration in accordance with an embodiment of the present invention.

Referring now to FIG. 6, in accordance with an embodiment of the present invention, asymmetrical cutting inserts 121 are positioned along the roller cone surface 122 in a non-linear pattern 120. It should be understood that FIG. 6 is not meant to limit the invention to only asymmetrical cutting inserts 121. Specific requirements of a formation being drilled may require differing combinations of cutting inserts and insert orientation. Generally, non-linear patterns 120 of, for example, all asymmetrical cutting inserts 121, generally chisel shaped cutting inserts (not illustrated), symmetrical cutting inserts (not illustrated), cutting surfaces not of the insert variety, or any cutting surface obvious to one skilled in the art can be configured in a similar pattern. Additionally, insert patterns whereby the angles of symmetrical cutting inserts (not illustrated) and asymmetrical cutting inserts 121 do not repeat, as well as embodiments whereby all of the cutting inserts have varied angles of orientation with respect to the cutting element axis, are still in the scope of the present invention.

Still referring to FIG. 6, the pattern of asymmetrical inserts 121 provides the additional advantage of greater adaptability of bottom hole coverage appropriate to facilitate the greatest formation removal in the shortest amount of time. In one embodiment of the present invention, the asymmetrical cutting inserts 121 angle away from the mid section 123 of the non-linear pattern 120 such as to create less overlap and greater overall bottom hole coverage. In another embodiment all of the inserts may be oriented in a way so as to create a mid section 123 that shifts with respect to the circumference of the roller cone. In still another embodiment, in accordance with the present invention, a plurality of cutting elements with differing crest directions may be disposed on the roller cone surface. Shifting the angle of the crest direction relative to mid section 123 provides expanded bottom hole coverage. The adaptability of being able to shift mid section 123 of the crater pattern provides the advantage of being able to more accurately select the appropriate amount of bottom hole coverage necessary to drill a given formation in the most efficient manner.

Figure 7:
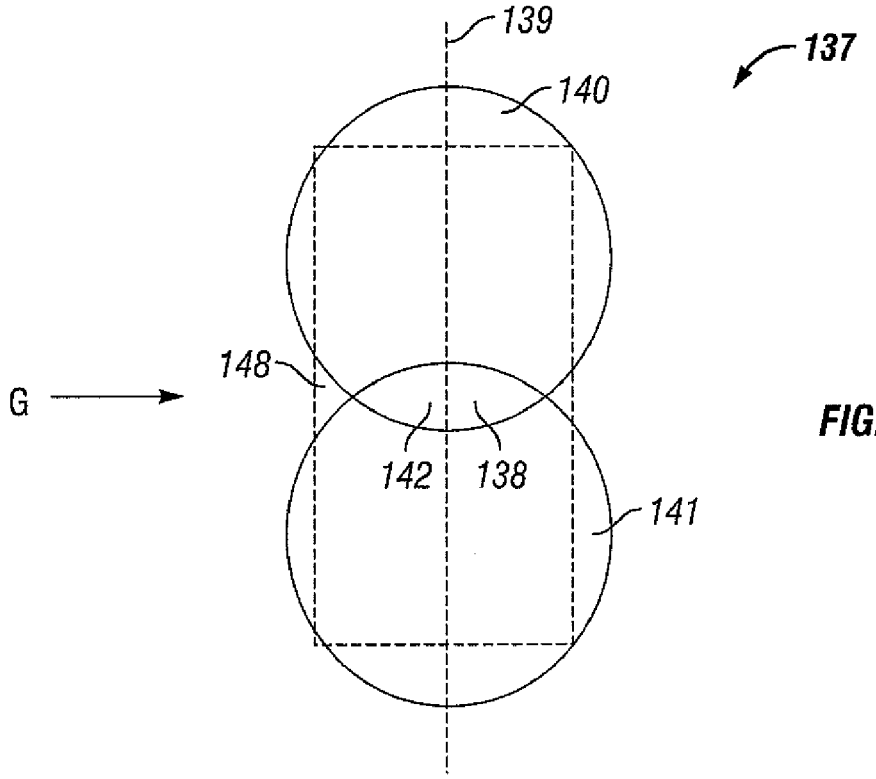
FIG. 7 is a top view drawing of a crater pattern created by a cutter element rotated 90° in accordance with an embodiment of the present invention.

FIG. 7 illustrates a cutting element crater 137 created in accordance with embodiments of the present invention in which chisel inserts (e.g. inserts having elongated crests) have been rotated 90° with respect to the axis of the portion of the cutting insert engaged within the roller cone. As an insert strikes the formation, it moves thereacross in direction G. The direct impression 138 of the insert crest in the formation results in an asymmetric crater 137 perpendicular to the roller cone axis 139. The 90° rotation of each insert provides for a greater overlap 140, 141, 142 across rows in the well bore hole which results in less undrilled formation 148. Specifically, the ends of the cutting insert relative to the axis of the roller cone of, for example, an asymmetrical cutting insert 121 or chisel cutting insert (not illustrated) would overlap across rows. This overlap effectively cuts formation undisturbed by the conventional inserts in FIG. 5. Minimizing the uncut ring section 32 of FIG. 5 removes the ridges which may cause inefficient drilling due to a slowed rate of penetration. While the shape of the crater, as illustrated, is specific to a chisel insert, other embodiments that produce differing crater shapes may be foreseen. Specifically, asymmetric craters that extend across rows in the well bore hole, thereby decreasing overlap, are within the scope of the present invention. Additionally, while the cutting element orientation, as illustrated, is rotated 90°, other embodiments wherein the cutting element is rotated 1° to 180° may be useful in drilling certain formations with greater efficiency.

Referring still to FIG. 7, the undrilled formation 148, in contrast with the undrilled formation 28 of FIG. 3, shows the greater total amount of bottom hole coverage achieved by the crater pattern 137 of FIG. 7. Additional advantages can be realized by utilizing embodiments of the present invention to select a laterally expanded asymmetric crater pattern 137 with respect to the roller cone axis 139, thus resulting in greater bottom hole coverage between roller cone rows. This configuration would be particularity useful in expanding bottom hole coverage in a formation where rate of penetration is adversely effected due to ridges which form between the insert rows, such as the areas of undrilled earth 32 illustrated in FIG. 5.

Figure 8:
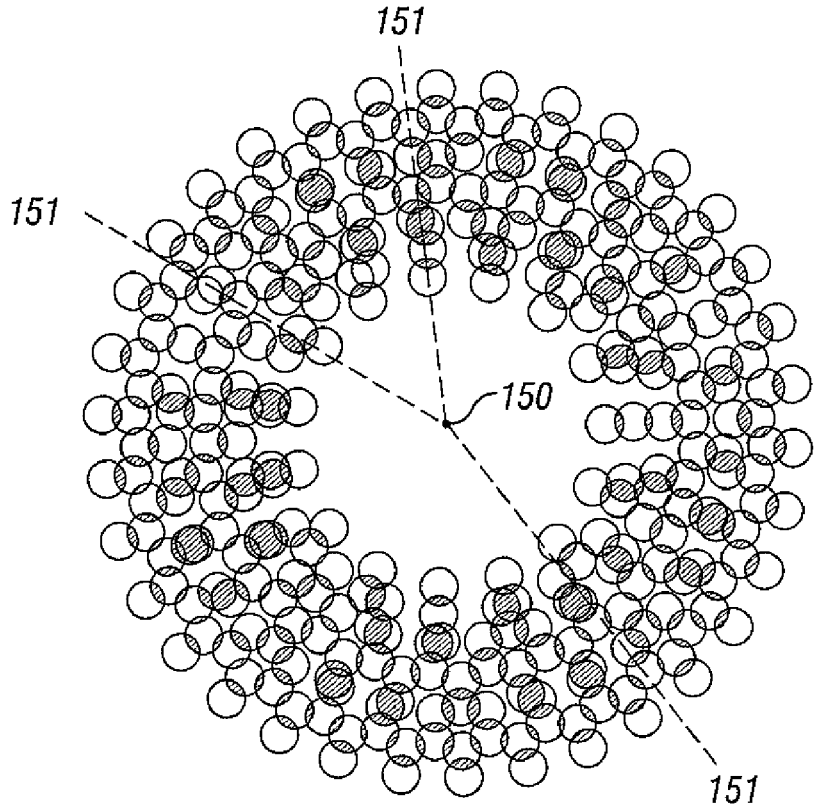
FIG. 8 is a top view of the bottom hole coverage of middle rows of cutter inserts oriented as depicted in FIG. 7 after three revolutions.

Referring now to FIG. 8, a top view of bottom hole coverage by a plurality of asymmetrical cutting inserts rotated 90° with non-linear orientation in accordance with crater pattern 137 of FIG. 7 is shown. One example of a non-linear insert pattern is a generally sinusoidal configuration, as illustrated by FIG. 8. With the plurality of asymmetrical inserts rotated 90°, and the inserts following a generally sinusoidal pattern, bottom hole coverage is radially expanded across rows relative to the crater impact 150, of the drill bit, thereby reducing the amount of uncut formation. The bottom hole coverage illustrated by FIG. 8 shows an advantage over the bottom hole coverage illustrated in FIG. 5, in that overlapping areas 140, 141, 142 of FIG. 7 extend both parallel and perpendicular to the center impact 150 of the drill bit. The roller cone axis 139 of FIG. 7 is essentially a plurality of radii 151 extending from the center impact 150 of the drill bit. Additionally, the areas of uncut substrate 32 in FIG. 5 are substantially eliminated with the asymmetrical inserts rotated 90° and configured in a sinusoidal fashion along the circumference of the roller cone bit.

Still referring to FIG. 8, the bottom hole coverage pattern created by rotating the plurality of asymmetrical inserts 90° and configured in a sinusoidal pattern is merely one embodiment of the present invention. Additional advantages are obtained by rotating any combination of symmetrical and asymmetrical inserts in a rotated and non-rotated fashion along a generally non-linear circumference of a roller cone. Furthermore, while FIG. 8 shows cutting inserts rotated 90°, it should be understood that additional advantages can be realized by rotating the inserts at angles greater or less than 90°. By rotating the cutting inserts such that the direct impression zone becomes angled, additional coverage patterns are possible that can offer numerous advantages to specific formations.

Figure 9:
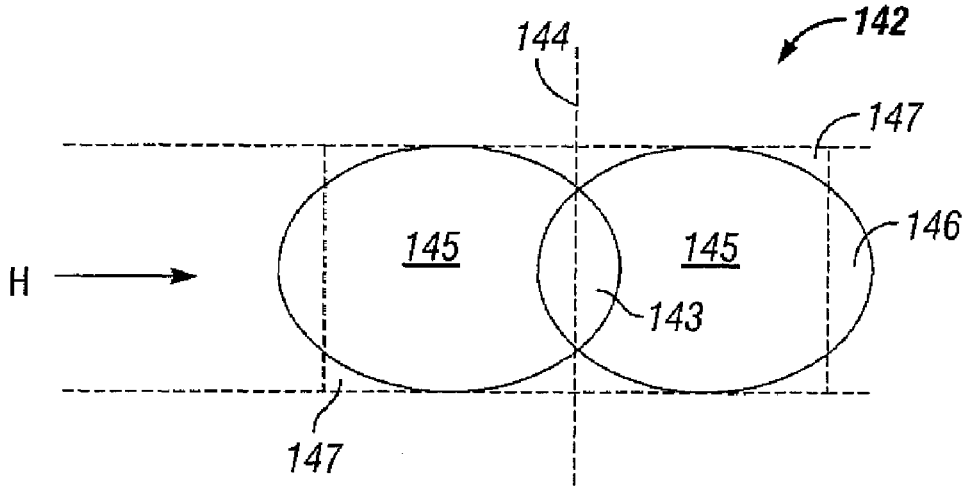
FIG. 9 is a top view drawing of a crater pattern created by a cutter element in conventional orientation in accord with an additional embodiment of the present invention.

FIG. 9 illustrates an alternative embodiment of the present invention in which an asymmetric crater 142 is created using a standard non-linear configuration of asymmetrical cutting inserts. In this embodiment of the present invention, the direct impression 143 is substantially parallel to the roller cone axis 144, and is created by rotation of the roller cone along direction H. The effective crater zone 145 extends laterally to overlap 146 direct impression 143 zones of previous revolutions, thus reducing the area of uncut bottom earth 147. The areas of overlap 146, as illustrated, extend in a lateral manner. In contrast with FIG. 3, wherein the compressed circular crater 27*a* and the substantially oblong crater 27*b*, leave areas of uncut formation 28, the effective crater zone 145 of FIG. 9 is expanded so as to provide lateral overlap in a cutting pattern. The increased consistency of the laterally expanded effective crater zone 145 also provides greater bottom hole coverage resulting from smaller zones of uncut formation 147. However, it should be understood that other configurations are possible that allow the modification of the non-linear curvature and cutting insert orientation to create areas of overlap 146 parallel to the roller cone axis 144.

Figure 10:
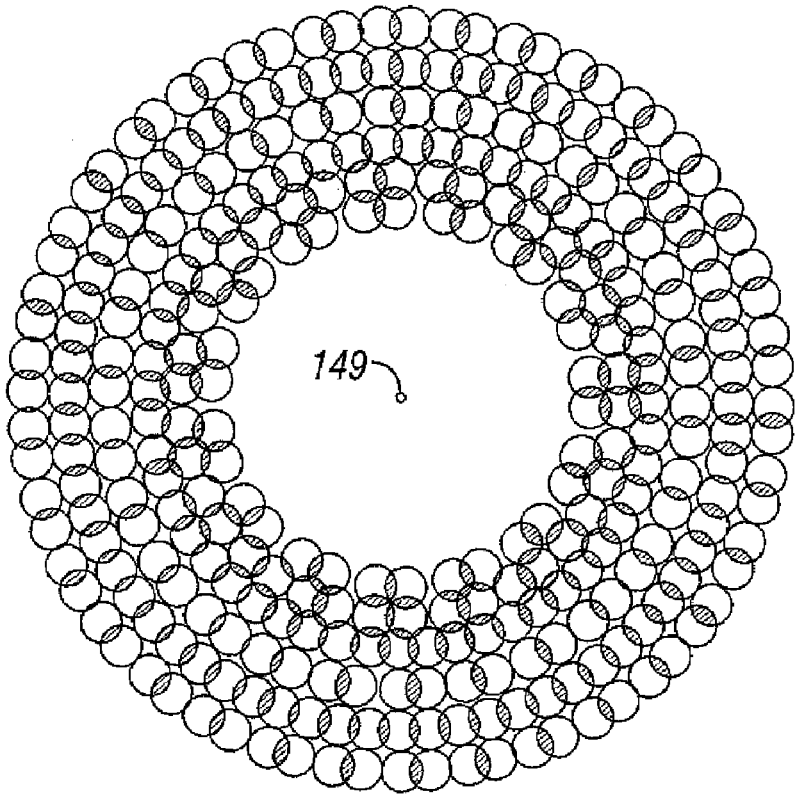
FIG. 10 is a top view of the bottom hole coverage of middle rows of cutter inserts oriented as depicted in FIG. 9 after three revolutions.

Referring now to FIG. 10, an elevated view of the bottom hole coverage of an asymmetrical cutting insert with non-linear orientation in accordance with asymmetric crater pattern 142 of FIG. 9 is shown. The bottom hole coverage is expanded to allow greater overlap 146 of effective crater zones 145, thereby creating an advantage over FIG. 5 in that the rings of uncut substrate 32 are removed. As with FIG. 8, the roller cone axis 144 of FIG. 9 is essentially a plurality of radii through the center impact 149 of the drill bit. In this embodiment, asymmetric crater 142 runs substantially perpendicular to the roller cone axis 144 of FIG. 9, covering a greater bottom hole area than that of FIG. 5. The substantially complete bottom hole coverage is evidenced by the absence of the ring of uncut substrate 32 present in FIG. 5.

Figure 11:
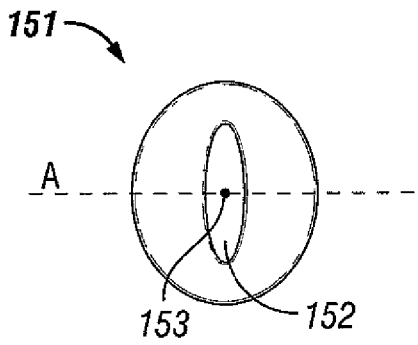
FIG. 11 is a top view drawing of a cutting insert in conventional orientation.
Figure 12:
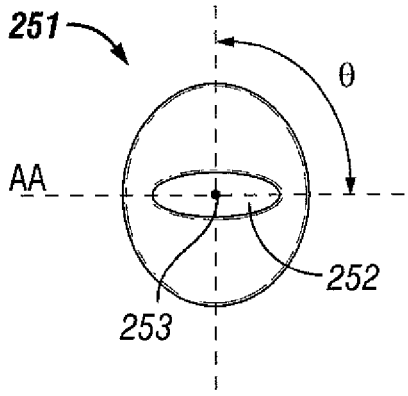
FIG. 12 is a top view drawing of a cutting insert in 90° rotated orientation in accordance with the present invention.

Referring to FIG. 11, a top view drawing of a cutting insert 151 in 0° orientation, wherein the cutting surface 152 of the cutting insert 151 is in line with the cutting element axis of orientation 153 is shown. In 0° orientation, the cutting element 151 is configured along the roller cone surface in a plane of travel A that the roller cone takes across a formation. Referring to FIG. 12, cutting insert 251 is shown in 90° rotated orientation. In this orientation, the cutting element 252 is rotated along the cutting element axis of orientation 253 creating an angle θ, which is shown in FIG. 12 to be approximately 90° relative to the roller cone plane of travel AA. While angle θ is shown in FIG. 12 to be approximately 90°, it should be understood by those skilled in the art that angles between 0° and 90° or between 90° and 180° may also be used. Therefore, the angle of rotation θ in relation to the cutting element axis of orientations 153 and 253 of FIGS. 11 and 12 can be any angle from 0° to 360°. Furthermore, the orientation of the embodiments depicted in FIGS. 11 and 12 utilize a chisel cutting insert, but it should be understood that any insert known to one skilled in the art may be used.

Figure 13:
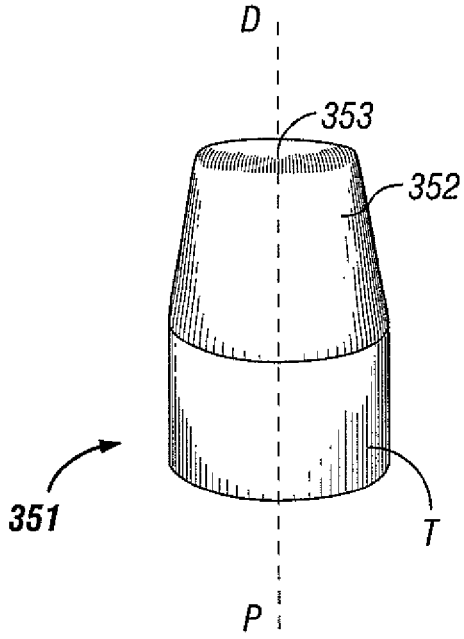
FIG. 13 is side view of a cutting insert in 90° rotated orientation in accordance with the present invention.

Referring now to FIG. 13, a side view of a cutting insert 351 with a cutting element 352 rotated in 90° orientation about axis of orientation 353 (253 of FIG. 12) is shown. Axis of orientation 353 runs in a plane from the proximal P end of the cutting insert which contacts the roller cone, through the center of cutting insert 351, and continues in a plane exiting cutting insert 351 in a distal D location. Cutting insert 352 can therefore be rotated in direction T with respect to axis of orientation 353 prior to press fitting the cutting insert 351 into the roller cone.

Figure 14:
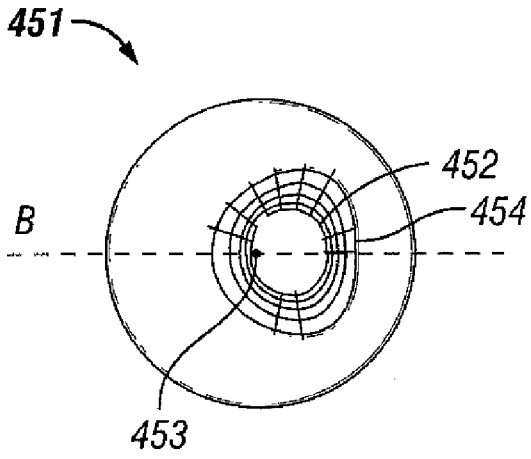
FIG. 14 is a top view drawing of an asymmetrical cutting element insert in conventional orientation.
Figure 15:
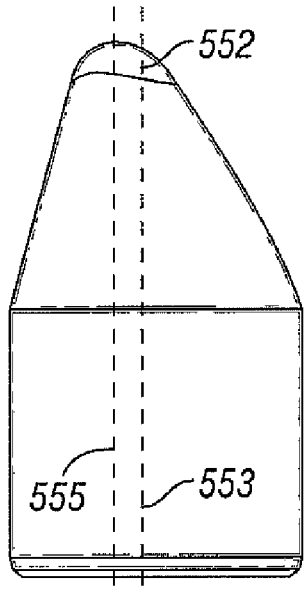
FIG. 15 is a side profile drawing of an asymmetrical cutting element insert.

Referring to FIG. 14, a top view of an asymmetrical cutting element (ACE) in 0° orientation, wherein cutting surface 452 of ACE insert 451 is in line with cutting element axis of orientation 453, is shown. In 0° orientation, cutting element 451 is configured along the roller cone surface in a plane of travel B that the roller cone takes across a formation. Other embodiments of the present invention may be foreseen, wherein leading edge 454 of ACE insert 451 is off-center to cutting element axis of orientation 453, or where cutting surface 452 is rotated perpendicular to plane of travel B. Referring briefly to FIG. 15, a side profile view of ACE insert 451 from FIG. 14, wherein cutting surface 552 is off-center to cutting element axis of orientation 553. In another embodiment of the present invention, the cutting element may be rotated with respect to cutting surface axis of orientation 555. Because cutting element axis of orientation 553 is distinct from cutting surface axis of orientation 555, ACE inserts may be rotated in a non-linear configuration with greater flexibility, removing formation more efficiently, thereby increasing the drill bit rate of penetration.

Figure 16:
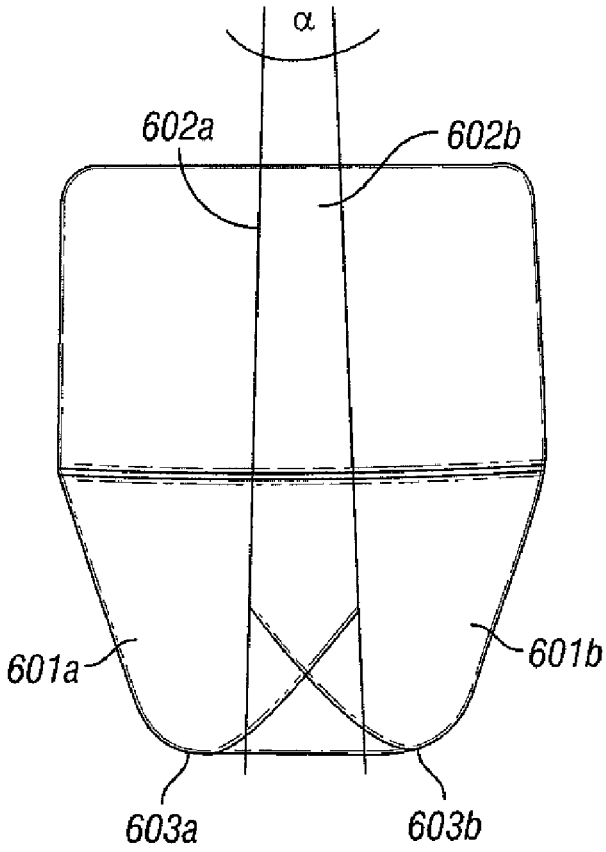
FIG. 16 is a schematic view of a roller cone showing two inserts in non-linear configuration in accordance with an embodiment of the present invention.
Figure 17:
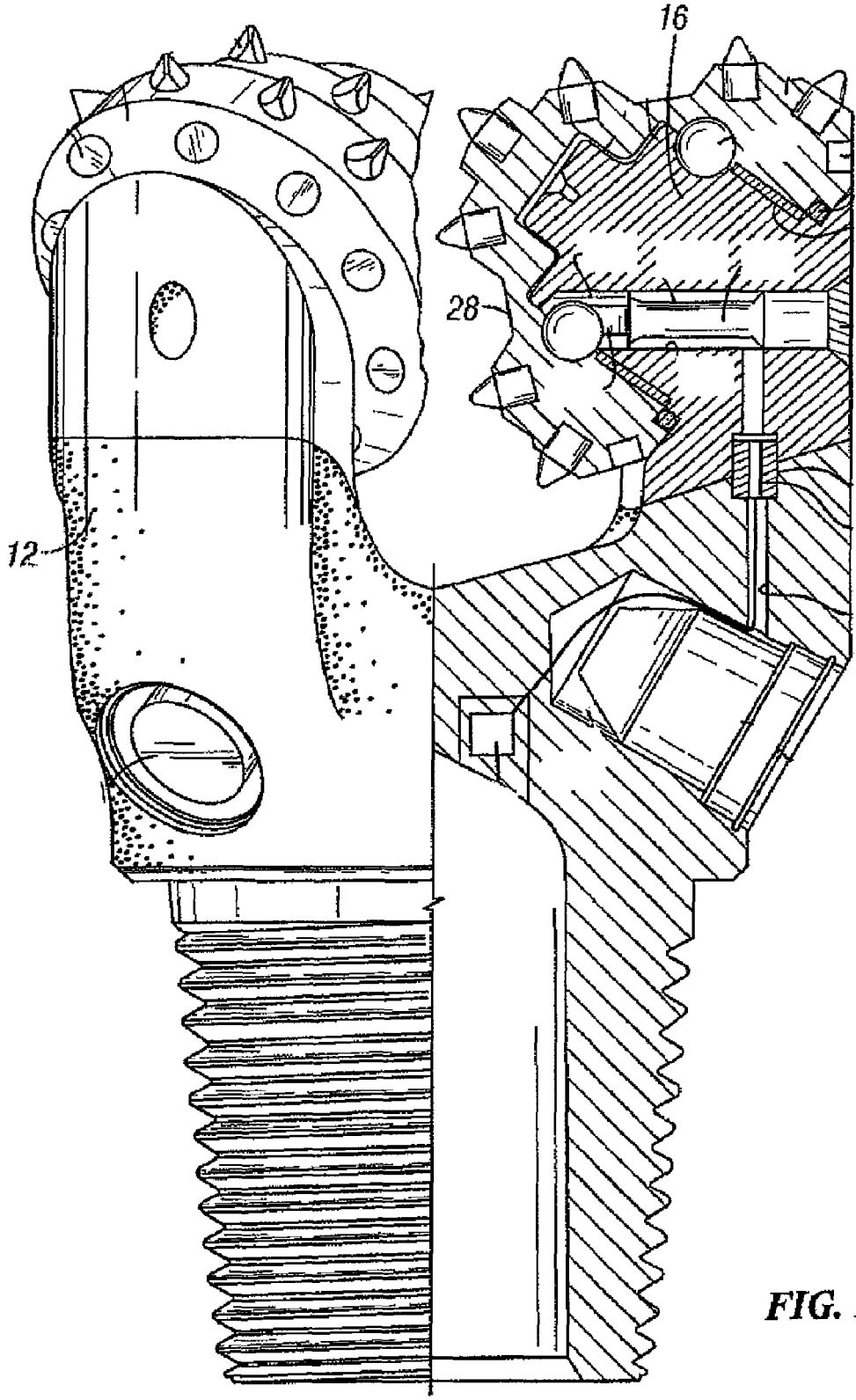
FIG. 17 is a perspective view of a roller cone drill bit according to one embodiment of the present disclosure.

FIG. 16 illustrates an embodiment of the present invention, wherein ACE inserts 601*a* and 601*b* are set into a roller cone surface in non-linear orientation. ACE inserts 601*a* and 601*b* have axis of orientation 602*a* and 602*b* respectively. Cutting surfaces 603*a* and 603*b* are angled in an outward direction relative to corresponding axis of orientation 602*a* and 602*b*. The outward angling provides inserts contact a greater area of formation, thereby increasing the drill bit rate of penetration. The angle of difference α between axis of orientation 602*a* and 602*b* illustrates ACE inserts 601*a* and 601*b* set in a roller cone surface whereby the ACE inserts respective axis of orientation are not parallel. Due to the curvature of the roller cone surface, when ACE inserts 601*a* and 601*b* are fit into the roller cone surface, the angle of difference α may be varied according to the specific requirements of a formation being drilled. Thus, angle of difference α may be varied to increase or decrease the distance between cutting surfaces 603*a* and 603*b*. By changing angle of difference α, additional coverage patterns are possible that can offer numerous advantages to rate of penetration, bottom hole coverage patterns, and insert strength.

To achieve the maximum bottom hole coverage for a particular formation, the correct cutting inserts configuration, and orientation of each cutting insert must be selected. In one embodiment in accordance with the present invention, a method to determine the correct design parameters for a particular formation may be to form test craters with selected inserts. Test craters may be used to calculate a geometric crater profile. The crater profile demonstrates what configuration on the roller cone surface and what orientation of the cutting element relative to the orientation axis results in the greatest bottom hole coverage. While this approach explains one method of orienting cutting elements on the surface of a roller cone, other approaches, such as development of multiple crater profiles and a plurality of orienting adjustments, fall within the scope of the present method.

Advantageously, a bottom hole crater pattern created by the present invention allows the craters from one row to connect easily with craters of another row, thus providing a greater area of bottom hole coverage. The overlap between rows results in less ridge build up, thereby preventing the decreased rate of penetration discussed above. Therefore, in one or more embodiments, the present invention increases bottom hole coverage through expanding and overlapping the effective crater zones. Furthermore, the present invention utilizes asymmetrical cutting inserts more efficiently than systems in accordance with the prior art. Specifically, more efficient use of the cutting surfaces allows the number of inserts to be decreased, thereby increasing the amount of effective work done by each insert. Finally, the present invention promotes the use of differing cutting surface geometry on the same row of a roller cone to more efficiently remove formation.

While the invention has been described with respect to a limited number of embodiments, those skilled in the art, having benefit of this disclosure, will appreciate that other embodiments can be devised which do not depart form the scope of the invention as disclosed herein. Accordingly, the scope of the invention should be limited only by the attached claims.

What is claimed is:

1. A drill bit comprising:

a bit body;

at least one roller cone rotatably mounted on a journal extending from the bit body, the roller cone defining a cone axis; and a plurality of cutting elements disposed on the roller cone, each cutting element including a cutting surface defining an axis of orientation and a portion engaged within the roller cone;

wherein the plurality of cutting elements is positioned upon the roller cone in a row that extends around a periphery of the roller cone in a generally non-concentric configuration;

wherein at least one cutting element in the row angles away from a mid-section of the row; and wherein at least one of the cutting surfaces, of at least one of the cutting elements is asymmetrical with respect to the axis of orientation.

2. The drill bit of claim 1, wherein at least one other of the plurality of cutting elements is symmetrical.

3. The drill bit of claim 1, wherein at least one of the plurality of cutting elements is a chisel insert.

4. The drill bit of claim 1, wherein one or more of the plurality of cutting elements is rotated 1 to 180 degrees about its axis of orientation.

5. The drill bit of claim 4, wherein the at least one cutting element is rotated such that a cutting face thereof is substantially 90 degrees from an axis of rotation of the roller cone.

6. The drill bit of claim 1, wherein two or more of the plurality of cutting elements have differing crest directions.

7. The drill bit of claim 1, wherein the non-concentric configuration is generally sinusoidal.

8. The drill bit of claim 1, wherein two or more of the plurality of cutting elements are disposed on the roller cone having axes of orientation that are not parallel.

9. A drill bit comprising:

a bit body;

at least one roller cone rotatably mounted on a journal extending from the bit body, the roller cone defining a cone axis; and a plurality of cutting elements extending from a row that extends around a periphery of the roller cone, each cutting element including an axis of orientation;

wherein at least one cutting element in the row angles away from a mid-section of the row; and wherein the plurality of cutting elements is positioned upon the roller cone in the row in a non-concentric configuration.

10. The drill bit of claim 9, wherein two or more of the plurality of cutting elements have differing crest directions.

11. The drill bit of claim 9, wherein at least one of the plurality of cutting elements is asymmetrical.

12. The drill bit of claim 9, wherein at least one of the plurality of cutting elements is a chisel insert.

13. The drill bit of claim 9, wherein the plurality of cutting elements is disposed upon the roller cone in a generally sinusoidal configuration.

14. The drill bit of claim 9, wherein at least one of the cutting elements is rotated such that a cutting face thereof is substantially 90 degrees from an axis of rotation of the roller cone.

* * * * *